US008210255B2

(12) United States Patent
Comacchio et al.

(10) Patent No.: US 8,210,255 B2
(45) Date of Patent: Jul. 3, 2012

(54) BORING HEAD WITH NEW PROTECTION HOOD

(75) Inventors: Pasqualino Comacchio, Riese Pio X (IT); Patrizio Comacchio, Riese Pio X (IT); Renzo Comacchio, Riese Pio X (IT)

(73) Assignee: Comacchio International S.A., Lugano (CH)

( * ) Notice: Subject to any disclaimer, the term of this patent is extended or adjusted under 35 U.S.C. 154(b) by 0 days.

(21) Appl. No.: 12/305,995

(22) PCT Filed: Jul. 4, 2006

(86) PCT No.: PCT/IT2006/000511

§ 371 (c)(1),
(2), (4) Date: Nov. 20, 2009

(87) PCT Pub. No.: WO2008/004255

PCT Pub. Date: Jan. 10, 2008

(65) Prior Publication Data

US 2010/0059282 A1 Mar. 11, 2010

(51) Int. Cl.
*E21B 40/00* (2006.01)

(52) U.S. Cl. ..... 166/209

(58) Field of Classification Search ..... 166/66; 175/206, 209, 214
See application file for complete search history.

(56) References Cited

U.S. PATENT DOCUMENTS

| | | | | |
|---|---|---|---|---|
| 4,521,232 | A | 6/1985 | Howeth | |
| 2003/0150610 | A1 * | 8/2003 | Ebner et al. | 166/214 |

FOREIGN PATENT DOCUMENTS

| | | |
|---|---|---|
| GB | 1584888 | 2/1981 |
| WO | 0188326 | 11/2001 |
| WO | 2005090738 | 9/2005 |

* cited by examiner

*Primary Examiner* — William P Neuder
*Assistant Examiner* — Kipp Wallace
(74) *Attorney, Agent, or Firm* — Themis Law

(57) ABSTRACT

A boring head system for boring machines includes couplings or drive units for the rotation-translation of at least one boring rod and of at least one covering tube that are coaxial and hollow, such to allow the passage of pressurized water/air as well as the upward flow of waste fluid consisting of water/air mixed with debris along the interspace defined between the rod and the covering tube, and also includes a protection screen or wall completely enveloping the rod and the covering tube, suited to be positioned near or at the level of an upper annular opening of the interspace, out of which the waste fluid flows, in such as way as to intercept the waste fluid in all directions and to convey it downwards.

7 Claims, 4 Drawing Sheets

BORING HEAD WITH NEW PROTECTION HOOD

The present invention concerns boring heads of earth boring machines, and in particular concerns a boring head with a new protection hood for containing and channelling the discharge flow of the boring debris.

Earth boring machines are known, which are suited to make holes or wells in the ground. The known boring machines are equipped with a boring tool connected to the boring head of the machine through an apposite hollow boring rod.

Said boring head comprises at least one coupling or drive unit for said boring rod and at least one further coupling for the covering tube of said boring rod, suited to support the walls of the bored hole.

Said couplings or drive units are set rotating by at least one motor, to which they are mechanically connected through a drive shaft. Said boring head, furthermore, translates in a direction that is substantially parallel to the support mast.

During the boring action, said boring head translates downwards and the motor transmits the rotary motion needed for the boring operation to the drive units and therefore also to the boring rod, the boring tool and the covering tube.

To facilitate the boring operation and remove the resulting debris, the boring machines are also equipped with a water pump or other device that injects a pressurised fluid into said boring rod in a downward direction, in such a way as to obtain the removal of the debris resulting from the boring operation.

The fluid, mixed with the boring residues, flows upwards along the interspace created between said boring head and said covering tube, until flowing out of the upper opening of said interspace, near said couplings or drive devices of the boring rod and of the covering tube.

Said couplings or drive devices are positioned near the boring head, that is, in a high position with respect to the ground level, and therefore said fluid mixed with the boring residues flows out and is spread and sprayed all around, dirtying not only the surface surrounding the boring hole, which is in itself a nuisance, but also the operators, the people and the machines in the vicinity thereof.

The uncontrolled outflow of water/air and debris may also create dangerous conditions for the people in the vicinity, as well as damage to things, machines and buildings.

Patent application PD2004U000027, filed on 19 Mar. 2004 by the same applicant filing the present patent application, concerned devices like panels or screens to be positioned near said discharge outlet and suited to partially hinder the spreading of the waste material mixed with water and/or air in some directions.

Said screens or panels can be effectively and practically used when it is necessary to prevent the dispersion of said waste fluid only in some specific directions.

In the case of said screens or panels, therefore, part of said waste fluid is conveyed downwards, along the boring rod and the covering tube, while the remaining part is spread in the directions that have been left free.

In order to overcome the above mentioned drawbacks, a new type of boring head for boring machines has been designed and implemented, said head being equipped with a new protection hood for containing and channelling the waste fluid made up of water/air and debris.

The main aim of the present invention is to develop a boring head where the flow of the mixed fluid made up of water/air and debris can be contained in all directions, thus preventing its uncontrolled spreading and dispersion. Another aim of the present invention is to be able to control the flow of air/water mixed with debris and to convey it downwards or towards a delimited area.

Another aim of the present invention is to be able to reduce the risks, for the machines and above all for the operators, caused by the uncontrolled dispersion of water.

A further aim of the present invention is to protect people, machines, objects and buildings in general from the jet of water/air and debris.

These and other direct and complementary aims have been achieved through the implementation of the boring head for boring machines with new protection hood for containing and channelling the flow of waste fluid consisting of water/air mixed with debris.

The hood is mechanically connected to the new boring head and is suited to be positioned near or at the level of the upper opening of the interspace between the boring rod and the covering tube, near the drive units and said boring head, in order to prevent the uncontrolled outflow and spreading of the waste fluid consisting of water/air mixed with debris in the surrounding area.

Said protection hood is an element that envelops completely said upper opening of the interspace between the boring rod and the covering tube, in such a way as to cover it in all directions, when necessary.

One of the innovative aspects of the new hood lies mainly in the fact that it provides a total screen, at 360°, against the uncontrolled dispersion of the waste fluid that is discharged from said upper opening of said interspace.

In this way, the waste fluid hits the inner wall of said hood, consuming its kinetic energy, and flows downwards due to gravity and/or is conveyed near the rod itself.

The flow of waste fluid is thus entirely intercepted and is not spread and sprayed in an uncontrolled manner in the surrounding area.

Most of the water and soil transported by the waste fluid is thus conveyed downwards along said drive units, said boring rod and said covering tube. Furthermore, the conveyed water may also be successively reused, after suitable treatments, for other purposes.

Said hood is extensible, for example it can be a bellows and/or a telescopic hood, so that it can be compressed, upwards or downwards, during maintenance and/or connection/disconnection of said boring rod and of said covering tube to/from the corresponding coupling or drive unit.

The hood instead is extended during the boring stage, in such a way as to cover completely said upper opening of the interspace, thus preventing the uncontrolled outflow of said waste fluid.

The expansion/contraction of the new hood is adjusted by means of apposite mechanical and/or hydraulic and/or electric devices, like for example one or more pneumatic-hydraulic pistons.

The characteristics of the new hood will be highlighted in greater detail in the following description with reference to the drawings that are attached as non-limiting examples.

FIG. 2 shows a front view of the invention, with the hood (C) with bellows wall (Cp) completely contracted, while FIG. 3 shows a side view of the invention where the bellows wall (Cp) of the hood (C) is expanded.

FIGS. 4 and 5 show two side views of the invention, with the bellows wall (Cp) of the hood (C) contracted and expanded, respectively.

Figure 6:
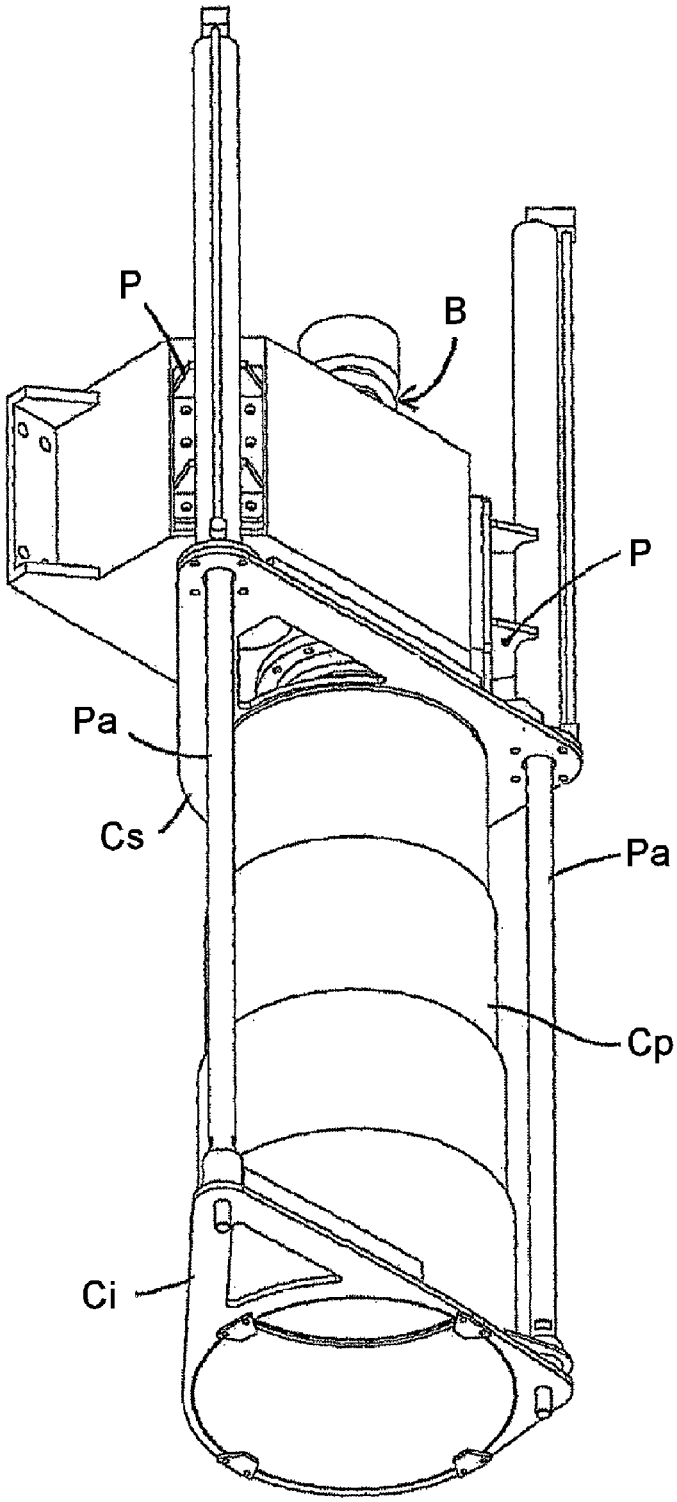

FIG. 6, instead, shows a three-dimensional view of a further possible embodiment of the new boring head (T), with protection hood (C) with telescopic wall (Cp).

Figure 7:
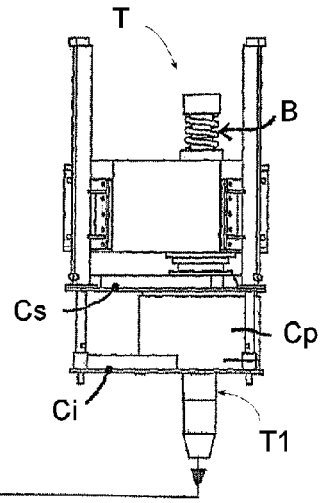
Figure 8:
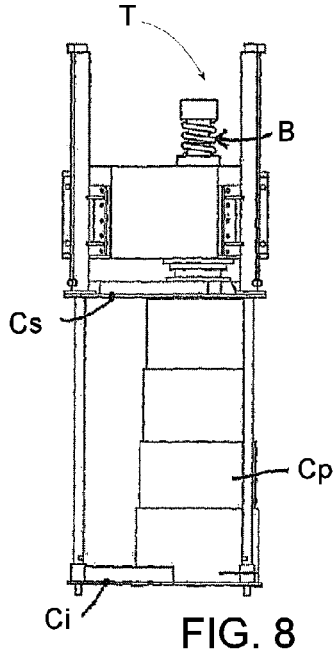

FIG. 7 shows a front view of the invention, with the telescopic wall (Cp) of the hood (C) completely retracted, while FIG. 8 shows a side view of the invention where the telescopic wall (Cp) of the hood (C) is extended.

Figure 9:
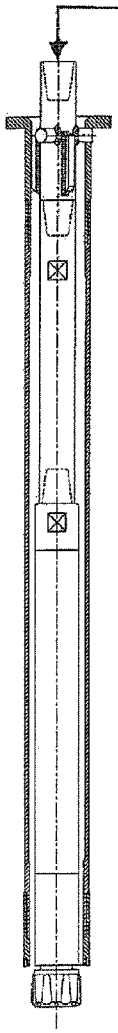
Figure 9:
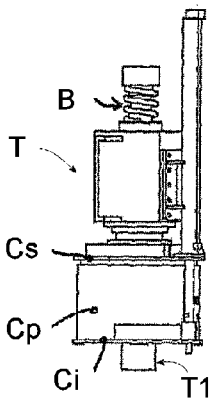
Figure 10:
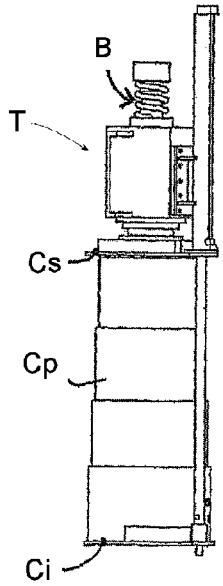

FIGS. 9 and 10 show two side views of the invention, with the telescopic wall (Cp) of the hood (C) retracted and extended, respectively.

The hood (C) is connected, through suitable devices described and claimed below, to the boring head (T) and/or to other mechanical parts of the boring machine and is positioned near one or more drive units where the boring rod (A) and the covering tube (D) are connected during the boring operation, that is, near the upper opening (F1) of the interspace (F) between the boring rod (A) and the covering tube (D).

Said boring rod (A) and said covering tube (D) are respectively connected to and made integral with the corresponding couplings or the one or more drive units (T1), for example through screwing, said couplings or one or more drive units being in turn connected to at least one drive shaft (B) that transmits the rotary motion generated by the motor.

Said boring rod and said covering tube are coaxial and between them there is an interspace through which the waste fluid consisting of debris mixed with water/air flows, said water/air being injected into said hollow rod during the boring operation; the waste fluid flow is then conveyed outside through the upper opening of said interspace.

One or more supports (P) of one or more pistons or other devices (Pa) suited to cause, as described below, the expansion/contraction of said hood (C) are fixed to and integral with said boring head (T).

Said devices, in this particular case shown in the figures, are pneumatic-hydraulic pistons (Pa) suited to cause the translation, in a direction substantially parallel to the axis of said shaft (B), of the bottom element (Ci) of said hood (C).

Said hood (C) comprises, in addition to the bottom element (Ci) that translates vertically, also at least one screen or wall (Cp), preferably tubular with a circular section, for example, whose bottom is fixed to said element (Ci) and whose top is fixed to a further element (Cs) that is connected to and integral with said boring head.

The operation of said pistons or devices (Pa) thus causes the translation of said bottom element (Ci) of the hood (C), but not of said fixed top element (Cs).

Figure 1:
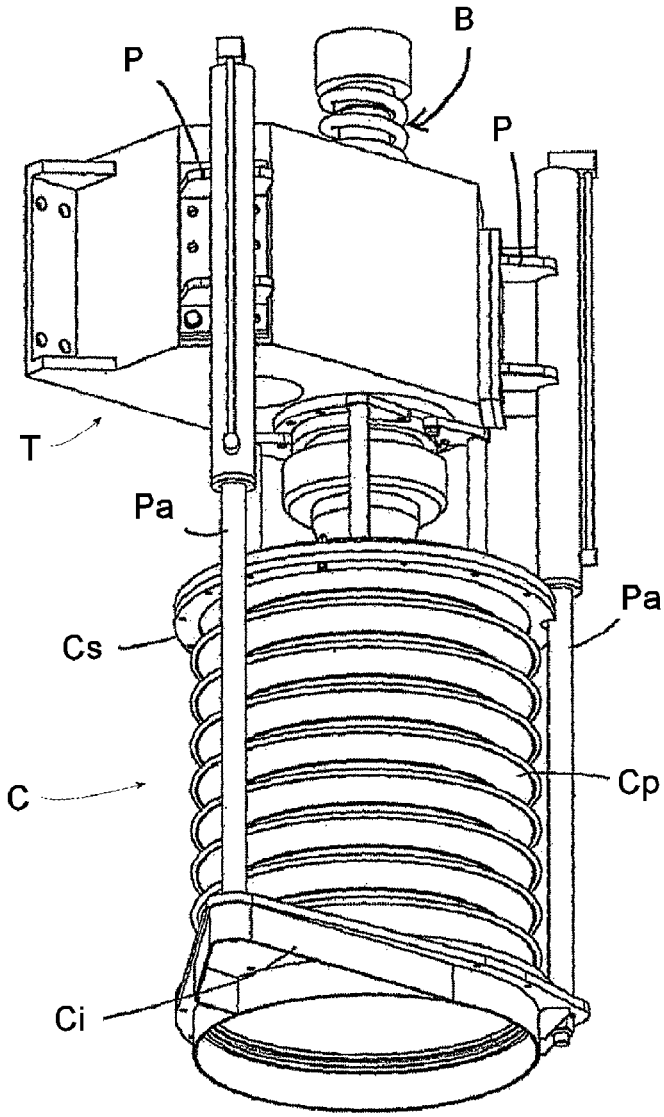
FIG. 1 is a three-dimensional view of the new boring head (T) with protection hood (C) with bellows wall (Cp).

Said screen or wall (Cp) is extensible, for example it can be structured as a bellows (FIG. 1) or telescopic (FIG. 6), which means that it is possible to increase/reduce the vertical extension of its surface.

Figures 2, 3, 4, 5:
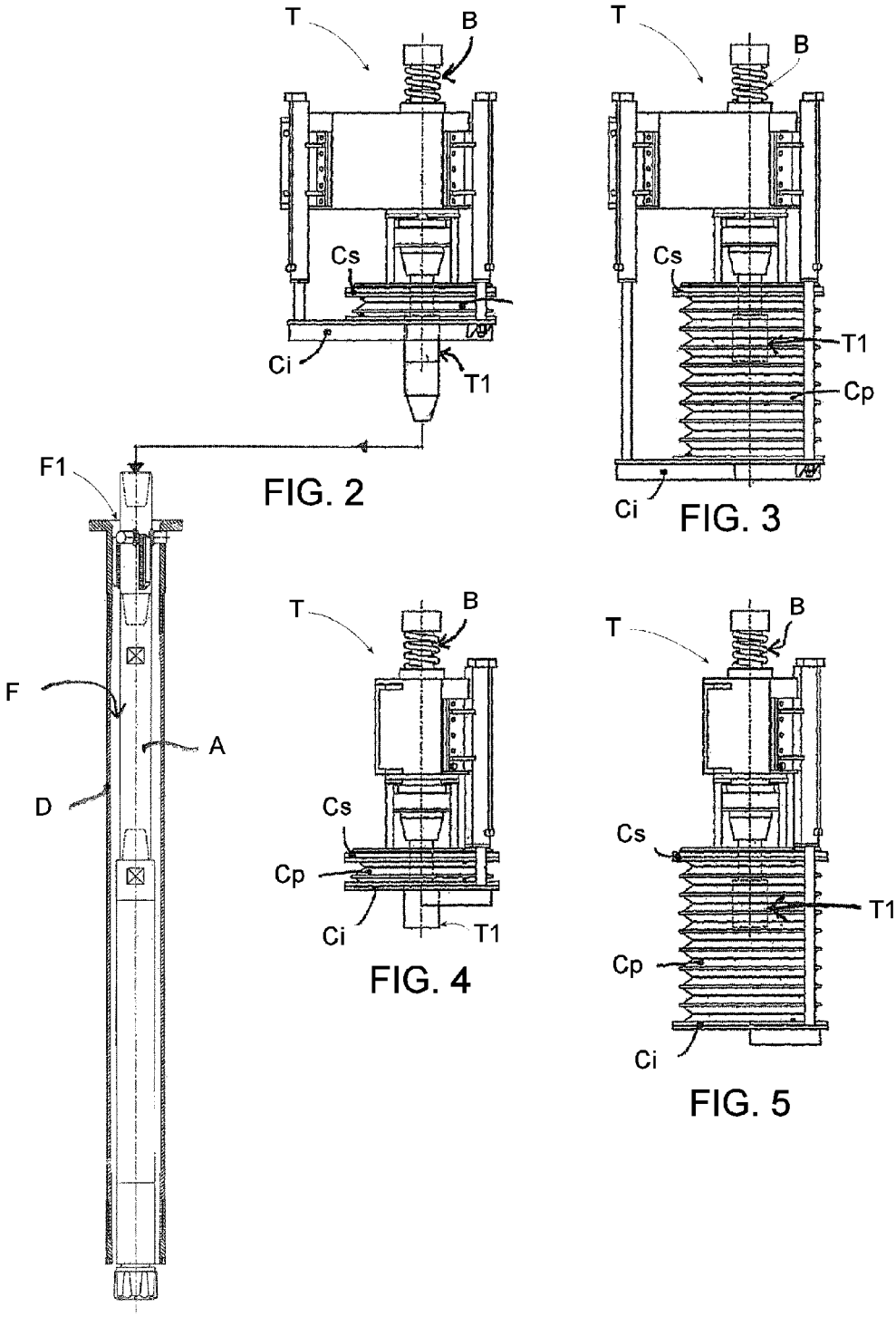

During maintenance or during the connection/disconnection of said boring rod (A) and covering tube (D), said pistons or devices (Pa) maintain said bottom element (Ci) in a raised position with respect to the connection point of said boring rod (A) and covering tube (D) to the corresponding one or more drive units (T1), so that the operators have free access during said operations (FIGS. 2 and 4). During the boring operation, before the waste fluid flows out of said upper opening of the interspace (F) between the rod (A) and the covering tube (D), said pistons or devices (Pa) are operated and cause the downward translation of said bottom element (Ci), thus determining the gradual extension of said screen or wall (Cp) of the hood (C), until said bottom element (Ci) is in a lower position with respect to said upper opening, that is, until said screen or wall (Cp) covers completely the opening itself, in such a way as to prevent the uncontrolled outflow of the waste fluid consisting of water/air mixed with debris in the surrounding area (FIGS. 3 and 5).

Said waste fluid flowing out of said opening, in fact, thus meets the inner surface of said screen or wall (Cp) of said hood (C) and flows downwards due to gravity.

Therefore, with reference to the above description and the attached drawings, the following claims are expressed.

The invention claimed is:

1. A boring head system for boring machines comprising:

a boring head comprising, a boring rod, a drive unit configured to rotate and translate the boring rod, and a covering tube coaxial with the boring rod and configured to allow passage of a waste fluid comprising pressurized water, air and debris along an interspace between the boring rod and an inner surface of the covering tube; and a protection screen or wall mounted on the boring head and completely enveloping at least a portion of the boring rod and of the covering tube, the protection screen or wall being configured to be disposed at or in proximity of an annular opening of the interspace, such to intercept substantially all of the waste fluid exiting from the annular opening and to convey the waste fluid downward during routine operation of the boring rod, thereby discharging the waste fluid to an outside environment, the protection screen or wall being extensible to cover or expose the drive unit.

2. The boring head system of claim 1, wherein the protection screen or wall is extensible longitudinally by a displacement of a first element coupled to a bottom of the protection screen or wall relative to a second element coupled to a top of the protection screen or wall.

3. The boring head system of claim 2, further comprising an element configured to cause and control the displacement, wherein the displacement causes a longitudinal extension and retraction of the protection screen or wall such to cover and uncover the annular opening of the interspace.

4. The boring head system of claim 3, wherein the element configured to cause and control the displacement is a pneumatic or hydraulic piston, coupled to the boring head or to a motor through suitable supports.

5. The boring head system of claim 2, wherein the first element translates in an essentially longitudinal direction, and wherein the second element is fixedly coupled to the boring head.

6. The boring head system of claim 1, wherein the protection screen or wall is bellows-shaped, telescopic, or elastic.

7. The boring head system of claim 1, wherein the protection screen or wall is tubular with a substantially circular cross-section.

* * * * *